United States Patent [19]

Alexander et al.

[11] 4,301,960

[45] Nov. 24, 1981

[54] PACKAGE FOR FOODSTUFFS

[75] Inventors: Richard G. Alexander, Bloomfield Hills; Earl F. Gilbert, Farmington Hills; Frederic J. Kelly, Birmingham, all of Mich.

[73] Assignee: Westvaco Corporation, New York, N.Y.

[21] Appl. No.: 151,736

[22] Filed: May 20, 1980

[51] Int. Cl.[3] ..... B65D 5/20

[52] U.S. Cl. ..... 229/30

[58] Field of Search ..... 229/30, 31 R, 42

[56] References Cited

U.S. PATENT DOCUMENTS

| | | | |
|---|---|---|---|
| 782,544 | 2/1905 | Carrier | 229/30 |
| 1,345,711 | 7/1920 | Shapiro | 229/42 |
| 2,330,311 | 9/1943 | Pierle | 229/30 X |
| 2,561,504 | 7/1951 | Dwyer | 229/42 X |
| 2,563,145 | 8/1951 | Winkler | 229/30 |
| 3,156,402 | 11/1964 | Dupuis | 229/30 |
| 3,493,122 | 2/1970 | McKee | 229/30 X |
| 3,721,380 | 3/1973 | Meyers | 229/30 X |
| 3,861,576 | 1/1975 | Tolaas et al. | 229/30 X |
| 3,876,132 | 4/1975 | Kuchembecker | 229/30 X |
| 4,081,125 | 3/1978 | Meyers | 229/31 R |

*Primary Examiner*—Herbert F. Ross

[57] ABSTRACT

A package for carryout foodstuffs or the like is prepared from the combination of an open ended tray and a cooperating outer protective bag. The tray is prepared from a single blank of paperboard or the like and is secured in its assembled condition with friction locks thereby obviating the need for glue, staples or other securing means. The tray comprises a pair of bottom panels, side walls attached to the bottom panels and an integral partition formed from two divider panels that are connected to the adjacent ends of said bottom panels. The outer bag is adapted to enclose the tray and its contents for delivery.

2 Claims, 4 Drawing Figures

PACKAGE FOR FOODSTUFFS

BACKGROUND OF INVENTION

The present invention relates to a combination one piece partitioned tray and bag, particularly for packaging foodstuffs such as pizzas. However, it will be appreciated from a careful review of the disclosure herein as a whole that the package of the present invention could readily be used for packaging other products.

More specifically, the present invention relates to a partitioned tray constructed from corrugated paperboard or the like wherein the partition separates the tray into two substantially equally sized areas and also doubles as a reinforcing rib which prevents the tray from collapsing during handling. Moreover, the tray of the present invention is capable of being set up and assembled by hand without the use of adhesives, staples or other fastening means. After the tray is assembled and loaded with two pizzas or other foodstuffs, the entire assembly is inserted in a bag or the like for safe keeping and transportation. The combination of the tray and bag provides an environment which protects the packaged products from contamination while the inherent strength of the tray allows the products to be transported without fear of the package collapsing.

Convenience foods such as pizzas, bakery goods and other foodstuffs, that are sold for carryout use, are traditionally packaged in paperboard containers. However, in some instances, the packages have little or no integrity and they often fail or collapse during transport thus spilling or otherwise damaging the packaged products. U.S. Pat. No. 3,721,380 illustrates such a package, however, it will be noted that the patented construction is glued and includes reinforced side and end walls to provide the desired rigidity. In addition, U.S. Pat. Nos. 3,876,132 and 4,081,125 also show partitioned trays that may be used for transporting foodstuffs, but in each case, the trays are reinforced and glued to provide a satisfactory result. Meanwhile, U.S. Pat. No. 3,861,576 also shows a tray type support, particularly for packaging pizzas. However, in the latter patent, the tray is designed as a cooking surface and is not intended for the same use contemplated for the present invention.

In constrast to the above noted prior art, the package of the present invention provides a less complicated construction, it is inexpensive to produce and it is adapted to be set up for use by hand with the aid of a simple tray holder located at the point of use.

SUMMARY OF INVENTION

In summary, the present invention is directed to a novel packaging system for carryout products such as pizzas, which comprises in combination an open end tray and a bag. The open end tray is cut and scored from a single blank of paperboard, such as corrugated paperboard, that is readily set up and assembled by hand without the aid of adhesive, staples or the like. After the tray is filled, it is readily slipped into its cooperating bag for safe transportation away from the carryout business. The cut and scored trays are preferably shipped to the user in flat blank form where they are readily set up using a tray holder provided for that purpose. In the assembled condition, the integral partition element of each tray provides rigidity to the tray structure and serves as a stacking support when several trays are stacked one upon the other. The integral partition element is provided with one or more friction locks which retain the tray in its set up condition. In this manner a reliable and simple package is provided for carrying at least two pizzas or other foodstuffs in a single unit.

Other objects, features and advantages of the invention will be apparent from the following detailed description taken in conjunction with the accompanying drawing.

DETAILED DESCRIPTION

Figure 1:
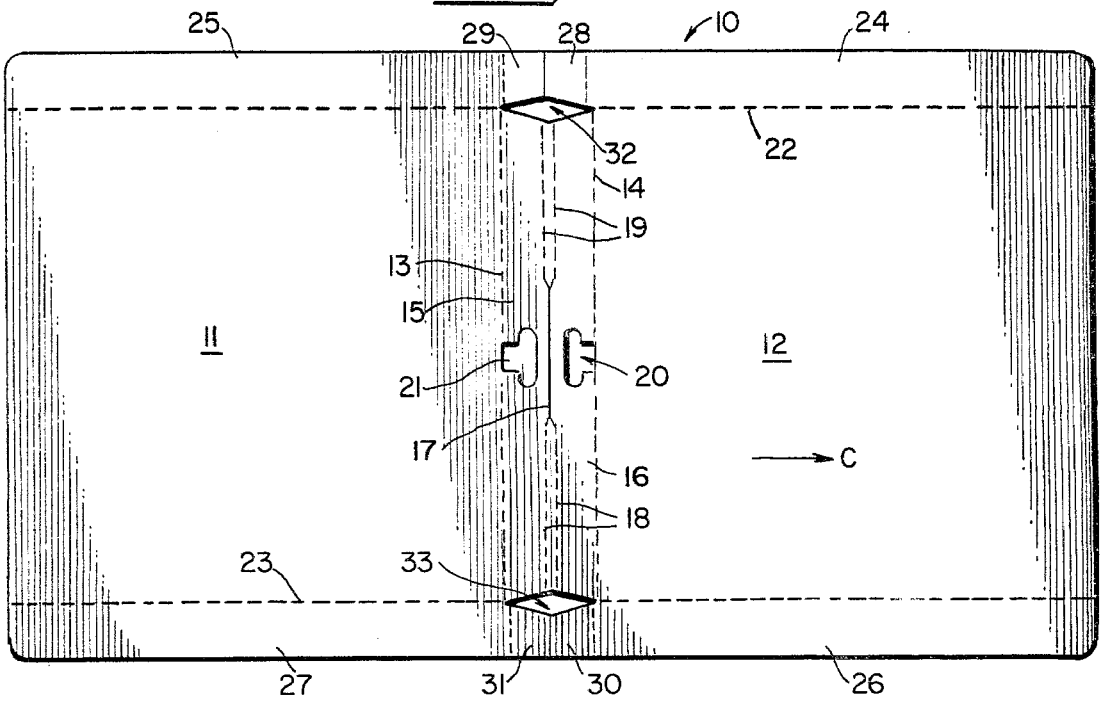
FIG. 1 is a plan view of a paperboard blank showing a preferred form for constructing the tray.

The tray blank 10 shown in FIG. 1 is generally of rectangular shape and is preferably cut and scored to provide a pair of bottom panels 11,12 separated from one another by a pair of partition panels 15,16. The partition panels 15,16 are attached to the bottom panels 11,12 by score lines 13,14 and are attached to one another by spaced apart score lines 18,19 and an interconnected cut line 17. The cut line 17 is located in the region of a friction locking means comprising a foldable tab 21 and a cut out 20 for the partition panels 15,16. In some instances, depending upon the overall dimensions of the blank, more than one frictional lock may be provided between the partition panels 15,16. In such instances, the blank is cut and scored accordingly.

At each side of the bottom panels 11,12 there are located side walls 25,27 and 24,26 foldably attached thereto along score lines 22,23. The latter score lines 22,23 are preferably oriented in the direction of the corrugations C with the score lines 13,14 being perpendicular thereto to achieve maximum strength. Meanwhile, a plurality of end flaps 28,29,30 and 31 are foldably attached to the ends of the side walls 24,25 and 26,27 to complete the blank.

As shown in FIG. 1, the end flaps 28,29,30 and 31 are each shaped to provide a pair of cut outs 32,33 at each end of the partition panels 15,16, however such an arrangement is not required. Other styles of end flaps could readily be used on the blank depending upon the size of the blank and the type of equipment used to manufacture the blank. In addition, as pointed out hereinbefore, more than one friction lock 20,21 can be applied to the blank as desired.

Figure 3:
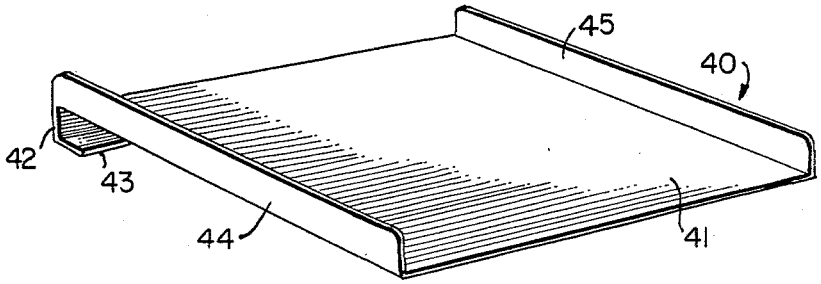
FIG. 3 is a perspective view of the tray holder used to set up the tray; and, FIG. 4 is a perspective view showing the loaded tray partially inserted in its cooperating outer bag.

In order to set up the tray blank in its usable configuration, a tray holder 40 substantially as shown in FIG. 3 may be used. The tray holder 40 is preferably constructed from a lightweight metal or the like and consists of a lower panel 41 with integral sides 44,45. The tray holder 40 is slightly elevated at one end by an integral arm 42 and an arm support 43. The slight angular orientation of the tray holder 40 aids in setting up the tray blank 10 and makes it easier for the user to assemble the tray. For this purpose, the tray side walls 24,25 and 26,27 are folded upwardly along their score lines 22,23 and inserted between the side panels 44,45 of the tray holder 40. At substantially the same time, the integral partition panels 15,16 are folded together about their combination score and cut lines 18,19 and 17 to capture the end flaps 28,29 and 30,31 which are folded between the partition panels 15,16. In this condition, the tray is fully set up but not locked together. To accomplish the latter function, one or more friction locks comprising matching cut outs 20 and foldable tabs 21 are provided in the partition panels 15,16. Thus, to hold the tray in its assembled condition, the user need only insert one or more of the foldable tabs 21 into a cooperating cut out 20 where the entire assembly becomes fully locked.

Figure 2:
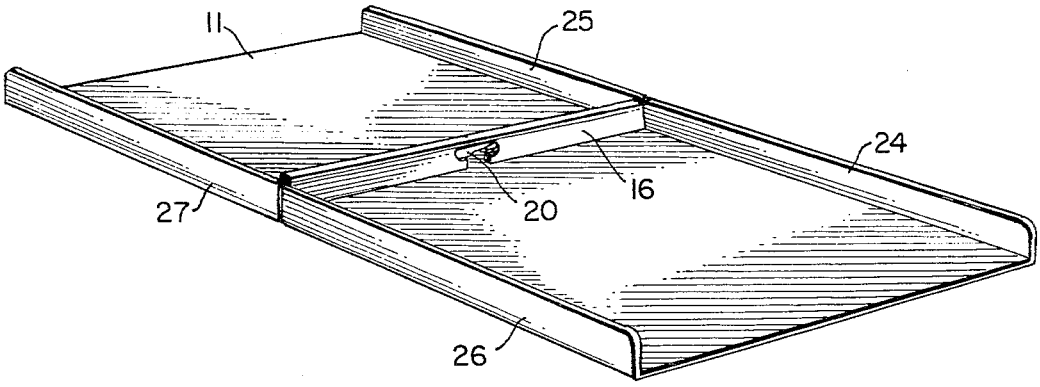
FIG. 2 is a perspective view showing the set up tray.
Figure 4:
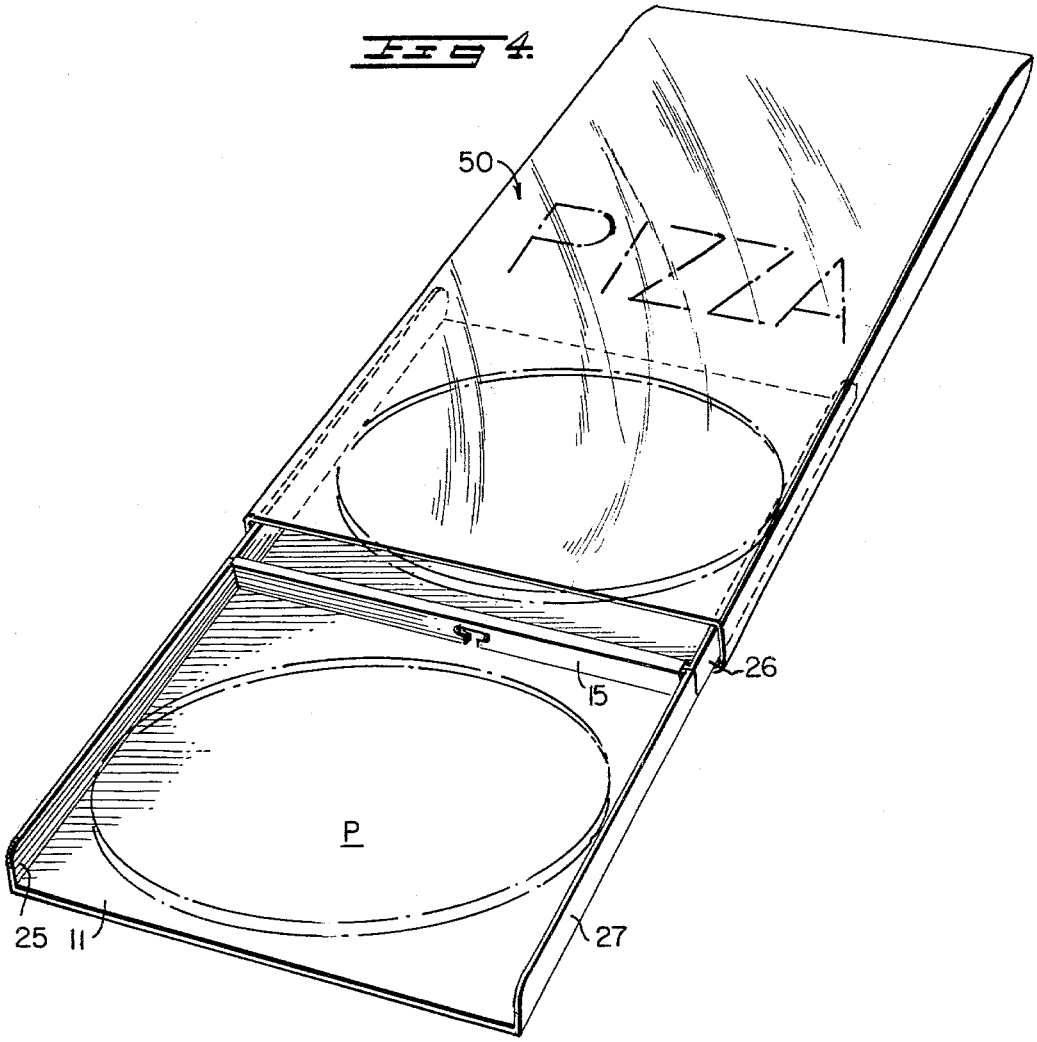

FIG. 2 illustrates the assembled tray ready to be filled and FIG. 4 shows a tray filled with two pizzas P being slipped into the outer cooperating bag 50.

Accordingly, while it is preferred to employ the form and arrangement of parts as shown in the drawing, the invention is not to be so limited except as set forth in the appended claims.

We claim:

1. A package for foodstuffs or the like comprising in combination an open partitioned tray formed from a single blank of paperboard and an enclosing bag, said tray including a pair of equally sized bottom panels separated from one another by a pair of partition panels, said partition panels being integral with and foldably attached to the tray bottom panels along the adjacent edges of said bottom panels and foldably attached together along a pair of spaced apart score lines except in a selected region thereof where a single cut line is applied, side walls foldably attached to the sides of said tray bottom panels, end flaps foldably attached to the adjacent ends of said tray side walls and folded between the partition panels when the tray is assembled, and at least one friction locking means integrally cut from said partition panels for retaining said tray in its assembled condition, said friction locking means comprising a cut out in one partition panel into which is inserted a foldable tab cut from the other partition panel said friction locking means being located in the region of the cut line between said partition panels.

2. The package of claim 1 wherein said outer bag is sized so as to completely enclose the filled tray when the package is prepared for delivery.

* * * * *